US006049925A

United States Patent [19]

Lewis

[11] Patent Number: 6,049,925

[45] Date of Patent: Apr. 18, 2000

[54] ONE-PIECE SHEET SET

[76] Inventor: Delphia Lewis, 3705 Egerton Rd., Baltimore, Md. 21215

[21] Appl. No.: 09/041,249

[22] Filed: Mar. 12, 1998

[51] Int. Cl.[7] ..... A47G 9/02

[52] U.S. Cl. ..... 5/497; 5/482; 5/485; 5/494; 5/500

[58] Field of Search ..... 5/482, 485, 494, 5/496, 497, 498, 499, 500

[56] References Cited

U.S. PATENT DOCUMENTS

| | | | |
|---|---|---|---|
| 3,638,251 | 2/1972 | Weiss | 5/497 X |
| 3,962,739 | 6/1976 | Crockett | 5/500 |
| 4,145,778 | 3/1979 | Ferrante et al. | 5/500 X |
| 4,237,805 | 12/1980 | Ferrante et al. | 5/500 X |
| 4,266,308 | 5/1981 | Shatz | 5/499 X |
| 4,924,543 | 5/1990 | Hoss et al. | 5/500 X |
| 4,964,184 | 10/1990 | Lewis | 5/498 X |
| 5,084,929 | 2/1992 | Staudinger | 5/498 X |
| 5,177,821 | 1/1993 | Kawtaski | 5/482 X |
| 5,438,719 | 8/1995 | Anthony | 5/497 X |
| 5,548,858 | 8/1996 | Shoa | 5/482 X |
| 5,901,389 | 5/1999 | Manner | 5/482 X |

FOREIGN PATENT DOCUMENTS

| | | | |
|---|---|---|---|
| 2608031 | 4/1986 | France | 5/497 |
| 2072007 | 9/1981 | United Kingdom | 5/498 |

OTHER PUBLICATIONS

Copy of a catalog page, catalog title unknown. Describing "180–Simplymade Deep Pocket Sheets", p. 56 and "Folding Bed Sheet Set", p. 55. Publisher, date and city unknown.

*Primary Examiner*—Terry Lee Melius
*Assistant Examiner*—Robert G. Santos

[57] ABSTRACT

A new one-piece sheet set for installing on a bed. The inventive device includes a bottom sheet coupled to a top sheet. The bottom sheet has first and second faces, head and foot end edges, and a pair of side edges. The top sheet has first and second surfaces, top and bottom ends and a pair of sides. The sheets are positioned such that the second surface of the top sheet faces the first face of the bottom sheet.

1 Claim, 3 Drawing Sheets

ONE-PIECE SHEET SET

BACKGROUND OF THE INVENTION

1. Field of the Invention

The present invention relates to bed sheets and more particularly pertains to a new one-piece sheet set for installing on a bed.

2. Description of the Prior Art

The use of bed sheets is known in the prior art. More specifically, bed sheets heretofore devised and utilized are known to consist basically of familiar, expected and obvious structural configurations, notwithstanding the myriad of designs encompassed by the crowded prior art which have been developed for the fulfillment of countless objectives and requirements.

Known prior art bed sheets include U.S. Pat. No. 4,964,184; U.S. Pat. No. 5,208,927; U.S. Pat. No. Des. 267,696; U.S. Pat. No. 4,802,251; U.S. Pat. No. 3,083,373; and U.S. Pat. No. 2,729,831.

While these devices fulfill their respective, particular objectives and requirements, the aforementioned patents do not disclose a new one-piece sheet set. The inventive device includes a bottom sheet coupled to a top sheet. The bottom sheet has first and second faces, head and foot end edges, and a pair of side edges. The top sheet has first and second surfaces, top and bottom ends and a pair of sides. The sheets are positioned such that the second surface of the top sheet faces the first face of the bottom sheet.

In these respects, the one-piece sheet set according to the present invention substantially departs from the conventional concepts and designs of the prior art, and in so doing provides an apparatus primarily developed for the purpose of installing on a bed.

SUMMARY OF THE INVENTION

In view of the foregoing disadvantages inherent in the known types of bed sheets now present in the prior art, the present invention provides a new one-piece sheet set construction wherein the same can be utilized for installing on a bed.

The general purpose of the present invention, which will be described subsequently in greater detail, is to provide a new one-piece sheet set apparatus and method which has many of the advantages of the bed sheets mentioned heretofore and many novel features that result in a new one-piece sheet set which is not anticipated, rendered obvious, suggested, or even implied by any of the prior art bed sheets, either alone or in any combination thereof.

To attain this, the present invention generally comprises a bottom sheet coupled to a top sheet. The bottom sheet has first and second faces, head and foot end edges, and a pair of side edges. The top sheet has first and second surfaces, top and bottom ends and a pair of sides. The sheets are positioned such that the second surface of the top sheet faces the first face of the bottom sheet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new one-piece sheet set apparatus and method which has many of the advantages of the bed sheets mentioned heretofore and many novel features that result in a new one-piece sheet set which is not anticipated, rendered obvious, suggested, or even implied by any of the prior art bed sheets, either alone or in any combination thereof.

It is another object of the present invention to provide a new one-piece sheet set which may be easily and efficiently manufactured and marketed.

It is a further object of the present invention to provide a new one-piece sheet set which is of a durable and reliable construction.

An even further object of the present invention is to provide a new one-piece sheet set which is susceptible of a low cost of manufacture with regard to both materials and labor, and which accordingly is then susceptible of low prices of sale to the consuming public, thereby making such one-piece sheet set economically available to the buying public.

Still yet another object of the present invention is to provide a new one-piece sheet set which provides in the apparatuses and methods of the prior art some of the advantages thereof, while simultaneously overcoming some of the disadvantages normally associated therewith.

Still another object of the present invention is to provide a new one-piece sheet set for installing on a bed.

Yet another object of the present invention is to provide a new one-piece sheet set which includes a bottom sheet coupled to a top sheet. The bottom sheet has first and second faces, head and foot end edges, and a pair of side edges. The top sheet has first and second surfaces, top and bottom ends and a pair of sides. The sheets are positioned such that the second surface of the top sheet faces the first face of the bottom sheet.

Still yet another object of the present invention is to provide a new one-piece sheet set that includes a top sheet, a fitted bottom sheet and a pillow case all in a single attached piece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
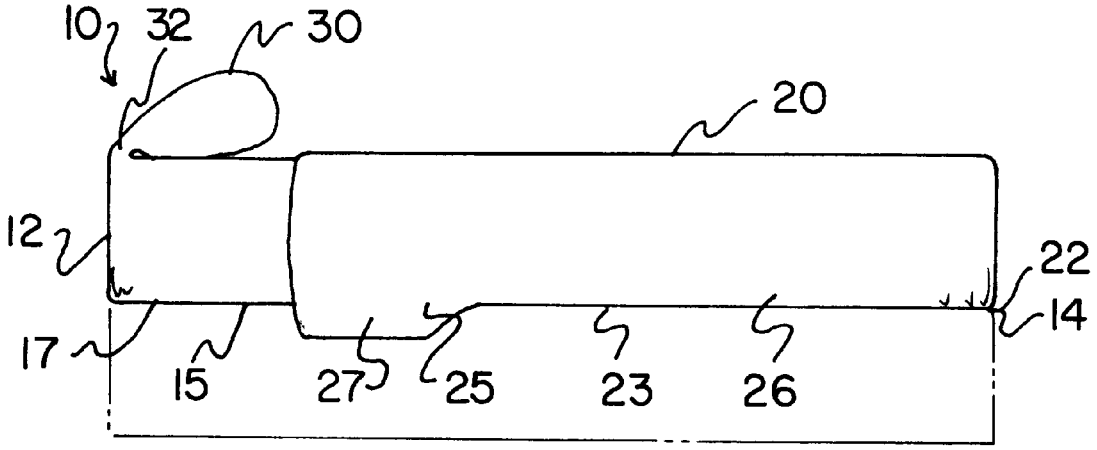
FIG. 1 is a schematic side view of a new one-piece sheet set on a bed mattress according to the present invention.
Figure 2:
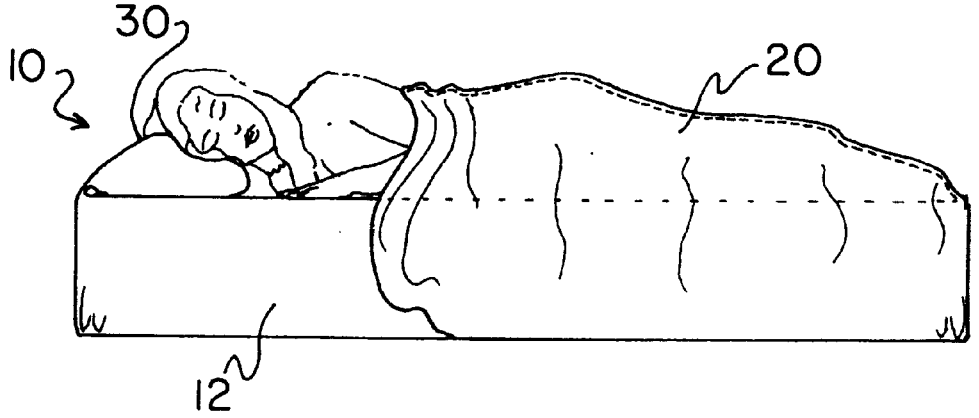
FIG. 2 is a schematic side view of the present invention on a regular sized bed.
Figure 3:
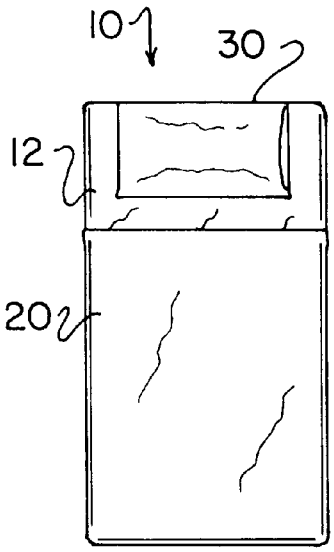
FIG. 3 is a schematic top side view of the present invention.
Figure 4:
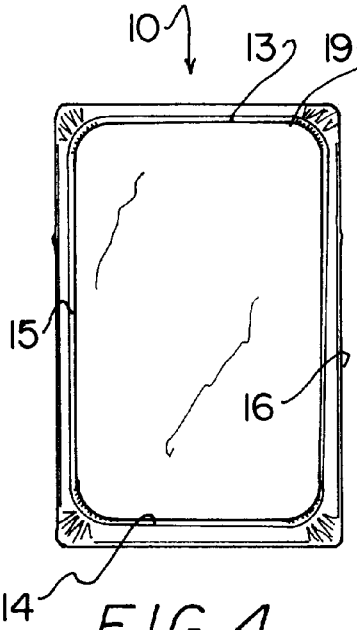
FIG. 4 is a schematic bottom side view of the present invention.
Figure 5:
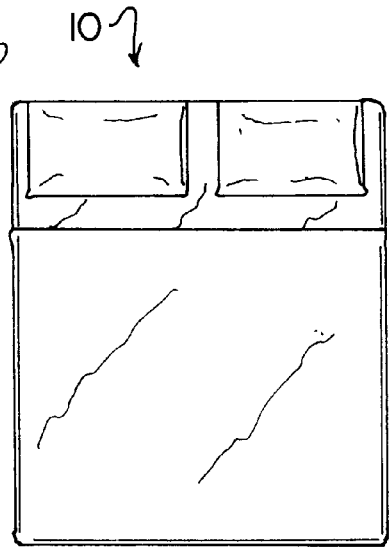
FIG. 5 is a schematic top side view of an embodiment of the present invention having two pillow case members.
Figure 6:
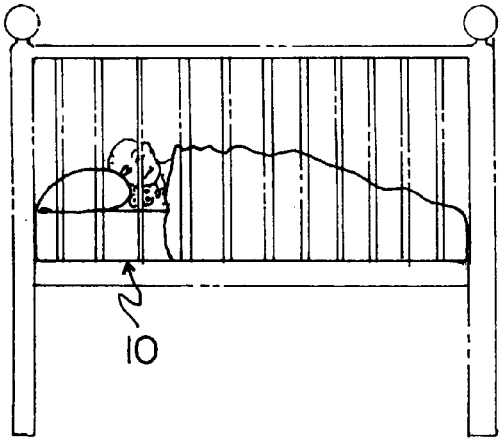
FIG. 6 is a schematic side view of an embodiment of the present invention in use on a baby mattress.
Figure 7:
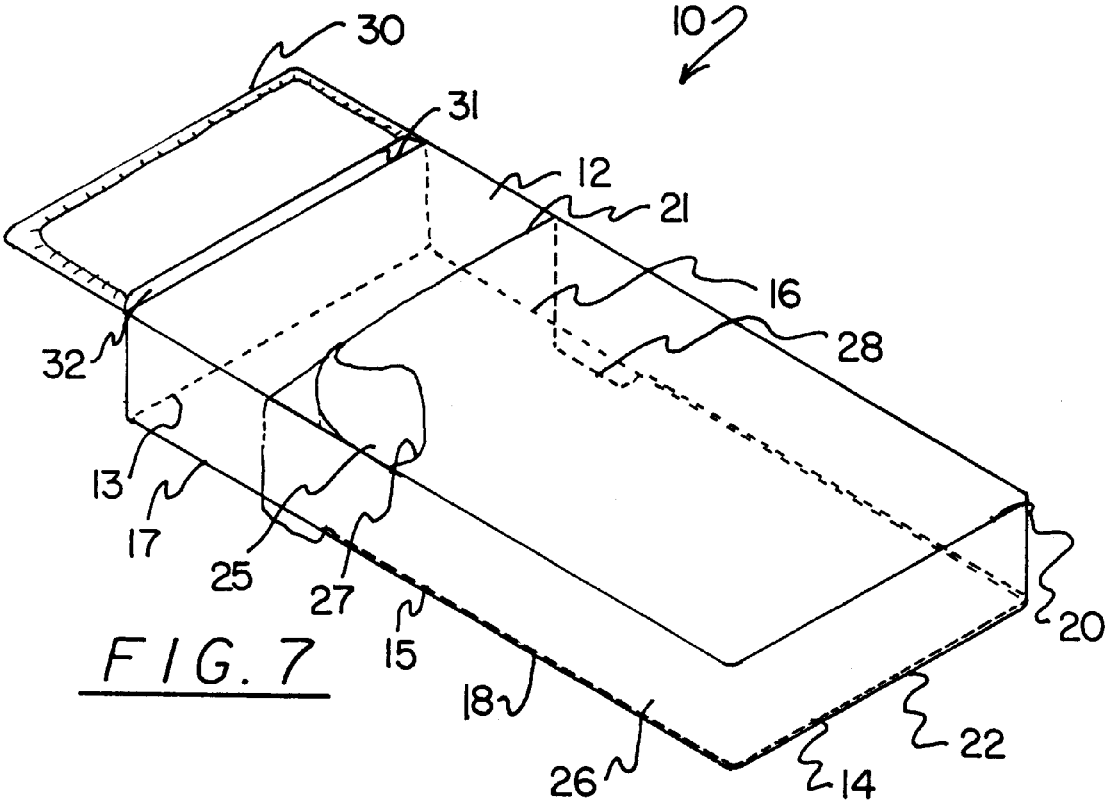
FIG. 7 is a schematic perspective view of the present invention.
Figure 8:
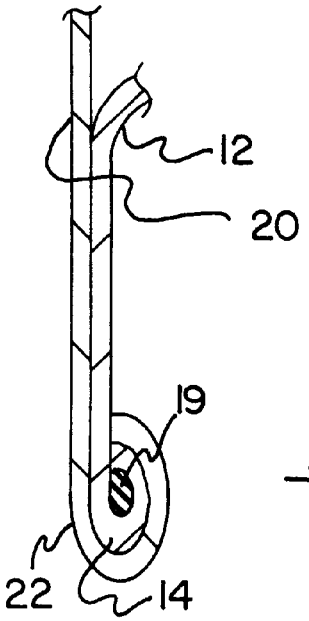
FIG. 8 is a schematic sectional view of a coupled edge region of the top and bottom sheets of the present invention.

With reference now to the drawings, and in particular to FIGS. 1 through 8 thereof, a new one-piece sheet set embodying the principles and concepts of the present invention and generally designated by the reference numeral 10 will be described.

As best illustrated in FIGS. 1 through 8, the one-piece sheet set 10 generally comprises a bottom sheet 12 coupled to a top sheet 20. The bottom sheet 12 has first and second faces, head and foot end edges 13,14, and a pair of side edges 15,16. The top sheet 20 has first and second surfaces, top and bottom ends 21,22 and a pair of sides 23,24. The sheets 12,20 are positioned such that the second surface of the top sheet 20 faces the first face of the bottom sheet 12.

The bed sheeting set 10 is designed for installation on a bed so that a user may quickly and easily make the bed. Specifically, the fitted bottom sheet 12 is generally rectangular and has first and second faces, head and foot end edges 13,14, and a pair of side edges 15,16. The end edges 13,14 and side edges 15,16 of the bottom sheet 12 define the outer perimeter of the bottom sheet. The bottom sheet 12 is designed for installing over a bed mattress. Each of the side edges 15,16 has first and second portions 17,18, with the first portion 17 of each side edge located towards the head end edge 13 of the bottom sheet 12 and the second portion 18 of each side edge located towards the foot end edge 14 of the bottom sheet 12. Preferably, an elastomeric band 19 is coupled to the bottom sheet 12. The elastomeric band 19 is extended around the bottom sheet outer perimeter and is adapted for helping hold the bottom sheet 12 on a mattress like a conventional fitted sheet.

The top sheet 20 is generally rectangular and has first and second surfaces, top and bottom ends 21,22 and a pair of sides 23,24. Each of the sides 23,24 of the top sheet 20 has front and rear regions 25,26 with the front region 25 of each side positioned adjacent the top end 21 of the top sheet 20, and the rear region 26 of each side positioned adjacent the bottom end 22 of the top sheet 20. Preferably, each of the sides 23,24 of the top sheet 20 has flap 27,28 extending from the front region 25 of the side of the top sheet 20 and positioned adjacent the top end 21 of the top sheet 20.

The sheets are coupled together such that the second surface of the top sheet 20 facing the first face of the bottom sheet 12. Preferably, the top sheet 20 is coupled the bottom sheet 12 such that the rear region 26 of one of the sides 23 of the top sheet 20 is coupled to the second portion 18 of one of the side edges 15 of the bottom sheet 12, the rear region 26 of another of the sides 24 of the top sheet 20 is coupled to the second portion 18 of another of the side edges 16 of the bottom sheet 12, and the bottom end 22 of the top sheet 20 is coupled to the foot end edge 14 of the bottom sheet 12.

Preferably, at least one pillow case member 30 is coupled to the first face of the bottom sheet 12. The pillow case member 30 is positioned towards the head end edge 13 of the bottom sheet 12. The pillow case member 30 has a pocket 31 therein adapted for receiving a pillow therein. Ideally, the pillow case member 30 has an attachment flap 32 located adjacent the pocket 31 of the pillow case member 30. The attachment flap 32 of the pillow case member couples the pillow member to the first face of the bottom sheet 12 such that the pillow case member 30 may be folded over the first face of the bottom sheet 12 to cover the pocket 31 of the pillow case member 30 from view.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed sheeting set, comprising:

a bottom sheet being generally rectangular and having first and second faces, head and foot end edges, and a pair of side edges, said end edges and side edges of said bottom sheet defining a bottom sheet outer perimeter;

each of said side edges having first and second portions, said first portion being located towards said head end edge of said bottom sheet, and said second portion of said side edge being located towards said foot end edge of said bottom sheet;

an elastomeric band being coupled to said bottom sheet, said elastomeric band being extended around said bottom sheet outer perimeter and being adapted for helping hold said bottom sheet on a mattress;

a top sheet being generally rectangular and having first and second surfaces, top and bottom ends and a pair of sides;

each of said sides of said top sheet having front and rear regions, said front region being positioned adjacent said top end of said top sheet, said rear region being positioned adjacent said bottom end of said top sheet;

each of said sides of said top sheet having flap extending from said front region of said side of said top sheet, said flap being positioned adjacent said top end of said top sheet;

said second surface of said top sheet facing said first face of said bottom sheet, said top sheet being coupled to said bottom sheet such that said rear region of one of said sides of said top sheet is coupled to said second portion of one of said side edges of said bottom sheet, said rear region of another of said sides of said top sheet is coupled to said second portion of another of said side edges of said bottom sheet, and said bottom end of said top sheet is coupled to said foot end edge of said bottom sheet, wherein the coupling of said sides of said top sheet to the said second portions of said bottom sheet extends about two-thirds of a distance between the head and foot end edges of the bottom sheet for helping hold a bed occupant in the bed;

a pillow case member being coupled to said first face of said bottom sheet, said pillow case member being positioned towards said head end edge of said bottom sheet, said pillow case member having a pocket therein adapted for receiving a pillow therein, said pocket having a mouth providing an opening therein to permit insertion of the pillow into said pocket, wherein said pillow case member has an attachment flap being located adjacent said mouth of said pocket of said pillow case member, wherein said attachment flap of said pillow member couples said pillow member to said first face of said bottom sheet such that said mouth of said pocket is positioned adjacent to said head end edge of said bottom sheet; and said pillow case member being folded along said attachment flap over said first face of said bottom sheet so that a free edge of said pillow case member is extended in a direction towards said foot end edge of said bottom sheet and such that said mouth of said pocket is covered from view by said attachment flap and said pillow case member.

* * * * *